US012427626B2

(12) United States Patent
Nguyen

(10) Patent No.: US 12,427,626 B2
(45) Date of Patent: Sep. 30, 2025

(54) METHODS AND SYSTEMS FOR ABRASIVE BLASTING

(71) Applicant: Axxiom Manufacturing, Inc., Fresno, TX (US)

(72) Inventor: Phuong Taylor Nguyen, Richmond, TX (US)

(73) Assignee: Axxiom Manufacturing, Inc., Fresno, TX (US)

( * ) Notice: Subject to any disclaimer, the term of this patent is extended or adjusted under 35 U.S.C. 154(b) by 145 days.

(21) Appl. No.: 17/707,161

(22) Filed: Mar. 29, 2022

(65) Prior Publication Data

US 2022/0339760 A1 Oct. 27, 2022

Related U.S. Application Data

(63) Continuation of application No. 17/241,466, filed on Apr. 27, 2021.

(51) Int. Cl.
*B24C 3/06* (2006.01)
*B24C 7/00* (2006.01)

(52) U.S. Cl.
CPC ..... *B24C 3/06* (2013.01); *B24C 7/0053* (2013.01)

(58) Field of Classification Search
None
See application file for complete search history.

(56) References Cited

U.S. PATENT DOCUMENTS

| | | | | | |
|---|---|---|---|---|---|
| 3,534,444 | A * | 10/1970 | Walker | D01G 15/34 | 19/95 |
| 3,834,082 | A * | 9/1974 | Grudzinski | B24C 5/02 | 451/99 |
| 4,135,068 | A * | 1/1979 | Burns | B24C 7/00 | 451/99 |
| 5,024,029 | A * | 6/1991 | Abbott | B25F 5/02 | 451/99 |
| 8,961,271 | B2 * | 2/2015 | Roden | B24C 7/00 | 451/39 |
| 2012/0273701 | A1 * | 11/2012 | Nguyen | F16K 35/025 | 251/98 |
| 2013/0157546 | A1 * | 6/2013 | Roden | B24C 7/0046 | 451/101 |
| 2017/0225297 | A1 * | 8/2017 | Trull, Jr. | B24C 7/0038 | |
| 2018/0130613 | A1 * | 5/2018 | Nguyen | H01H 13/506 | |
| 2021/0331290 | A1 * | 10/2021 | Mason | B24C 7/0046 | |

* cited by examiner

*Primary Examiner* — David S Posigian
*Assistant Examiner* — Dana Lee Poon
(74) *Attorney, Agent, or Firm* — Kearney, McWilliams & Davis, PLLC; John M. DeBoer

(57) ABSTRACT

An abrasive blasting system that includes a blast hose, and a deadman assembly coupled with the blast hose. The deadman assembly further includes a primary deadman switch and a secondary deadman switch. The deadman also has a base frame, with each of the primary deadman switch and the secondary deadman switch coupled with the base frame. There is a trigger member pivotably coupled with the base frame, the trigger member configured to contact and move the primary deadman switch to a signal-flow position, and also to contact and move the secondary deadman switch to a secondary signal-flow position.

20 Claims, 8 Drawing Sheets

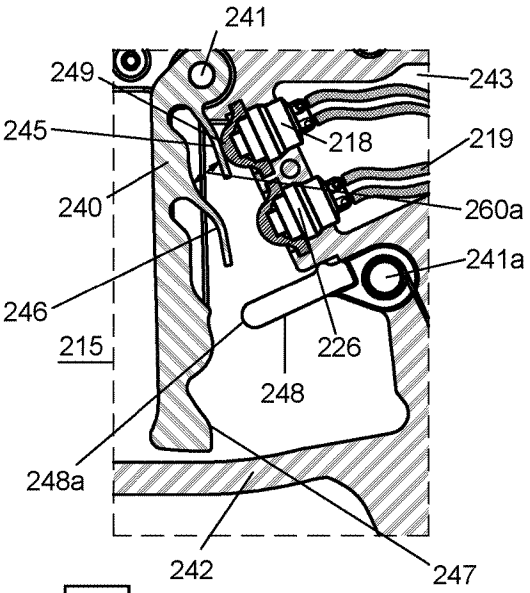
FIG. 2C
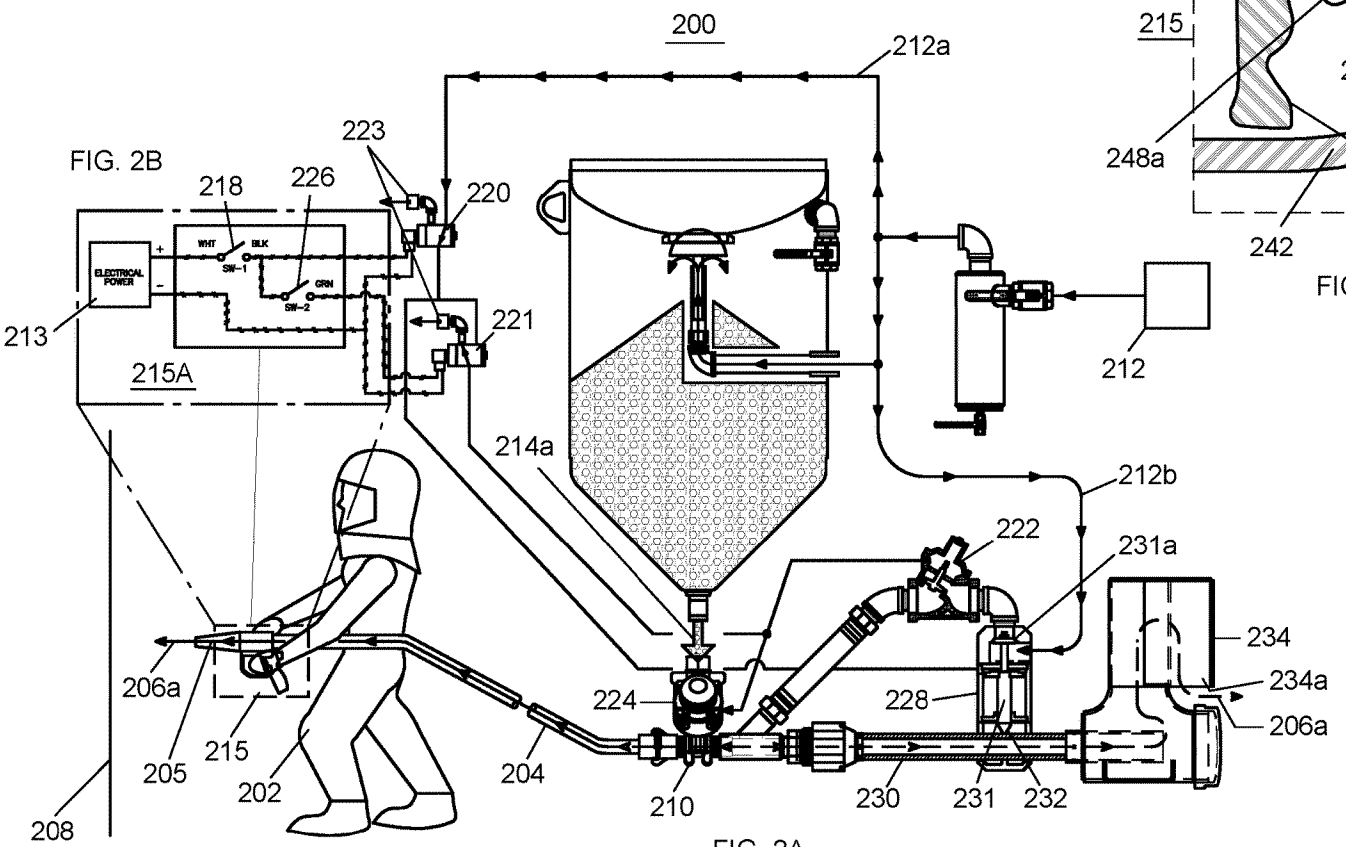
FIG. 2A
FIG. 2B

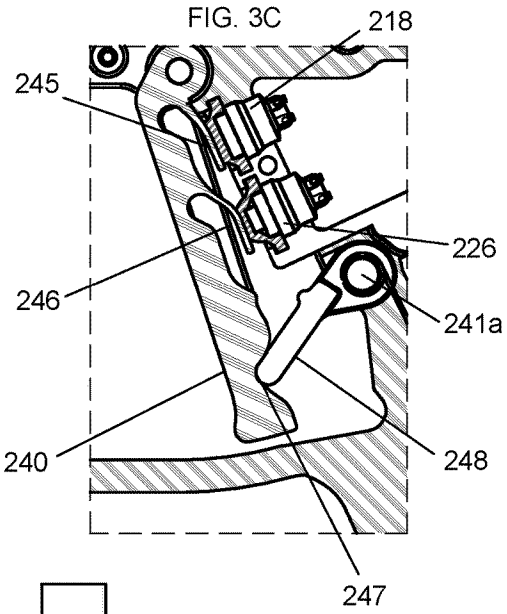
FIG. 3C
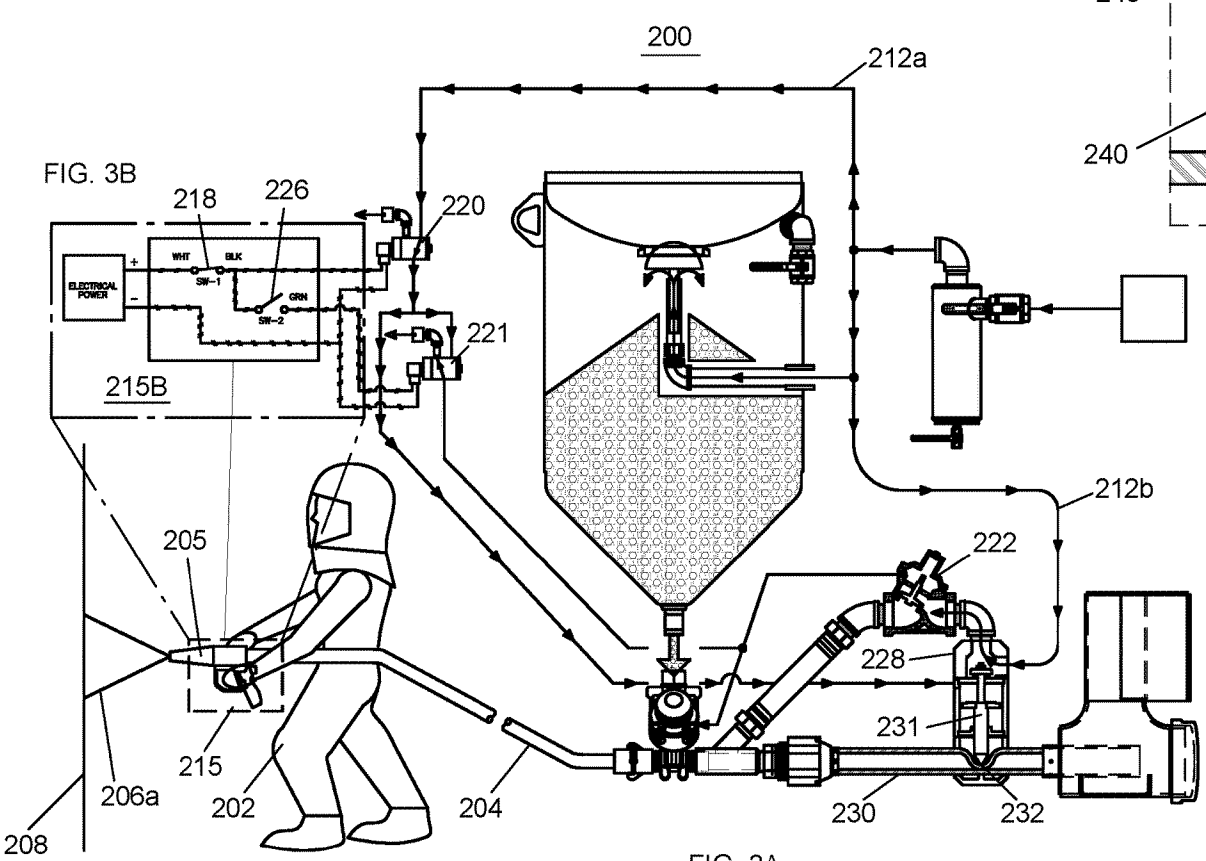
FIG. 3A
FIG. 3B

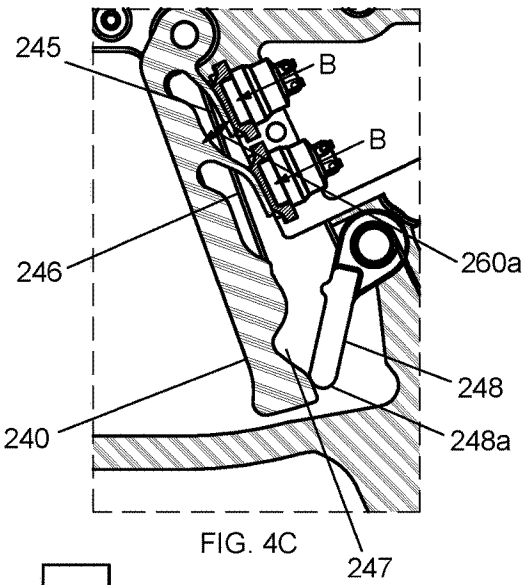
FIG. 4C
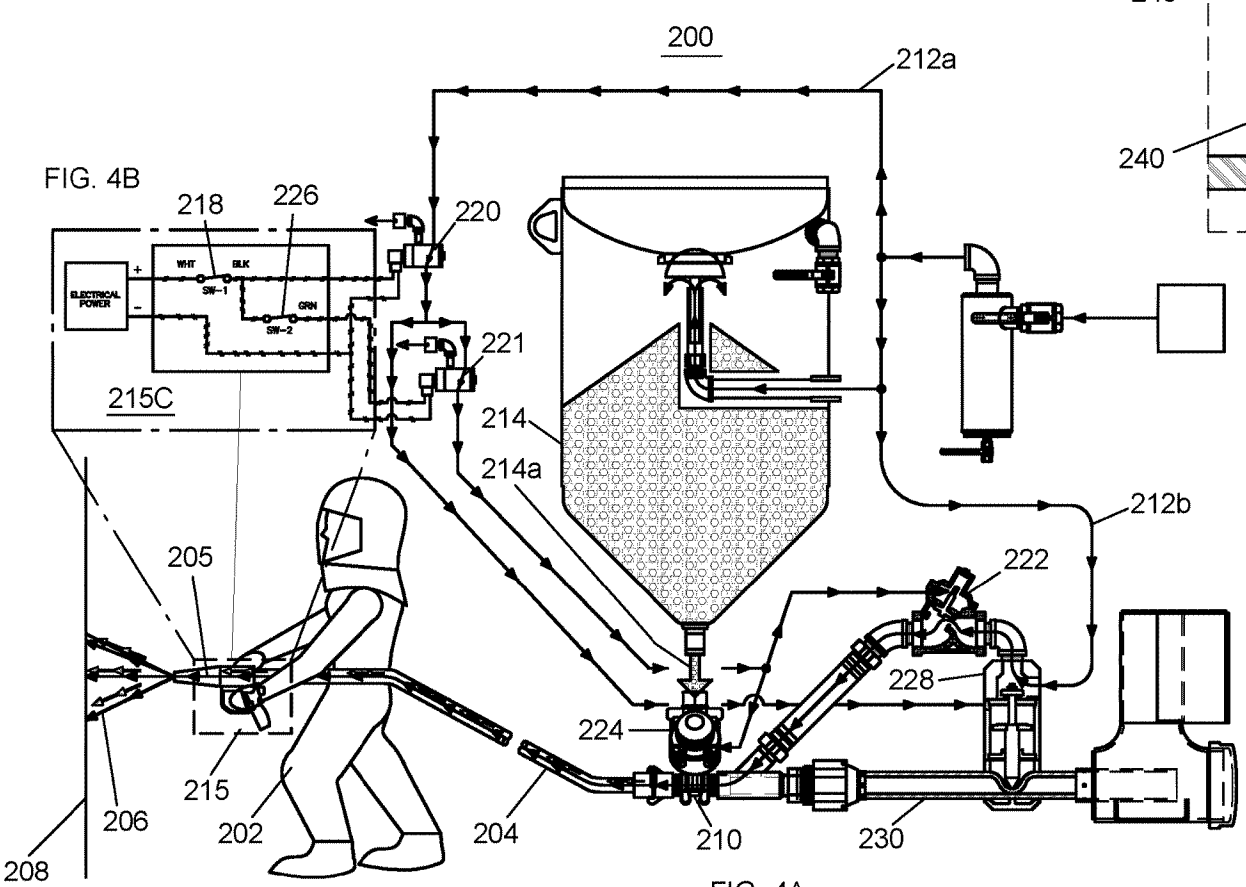
FIG. 4A
FIG. 4B

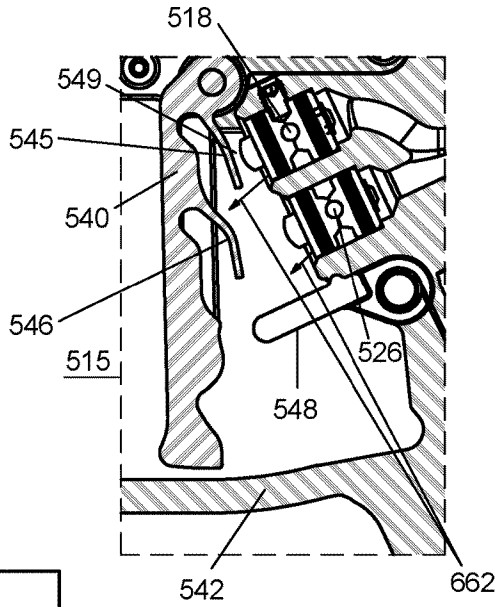
FIG. 5C
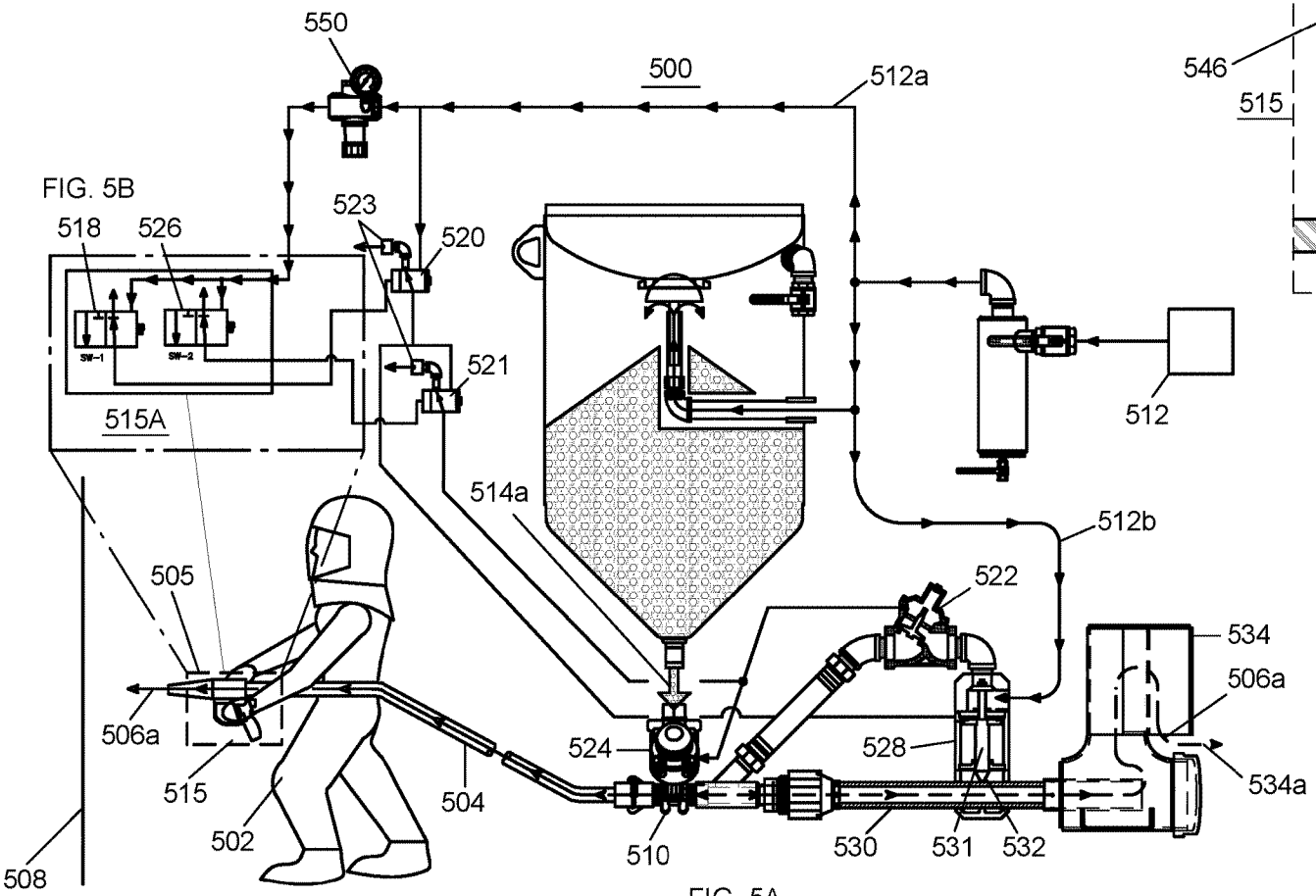
FIG. 5B
FIG. 5A 518
526
548
549
545
540
546
515
542

512
512b
534
532
522
528
531
530
512a
500
510
524
514a
520
521
523
550
504
502
505
515
506a
508
526
518
515B

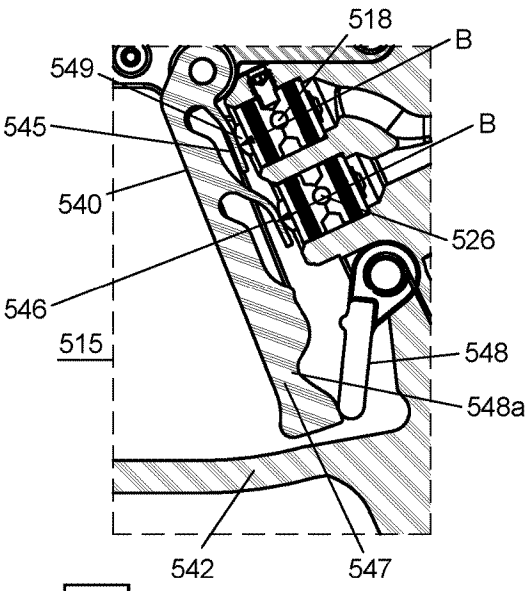
FIG. 7C
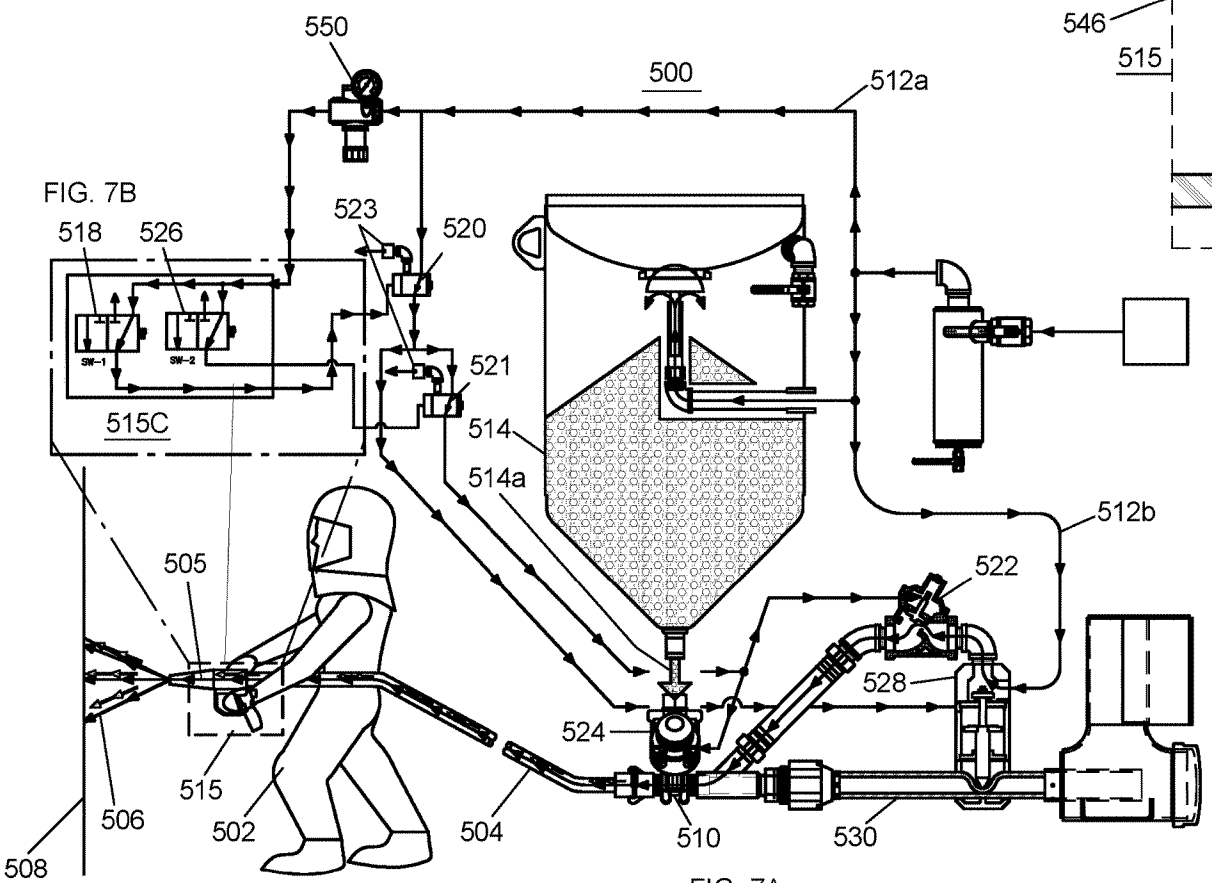
FIG. 7A
FIG. 7B

METHODS AND SYSTEMS FOR ABRASIVE BLASTING

BACKGROUND

Field of the Disclosure

This disclosure generally pertains to abrasive blasting, with related methods and systems, where the blasting may be wet, dry, or combinations thereof. More specifically, the disclosure relates to a multi-function deadman system.

Background of the Disclosure

Abrasive blasting is the process of forcibly propelling a high pressure, high velocity stream of abrasive material against a surface in order to smooth a rough surface, roughen a smooth surface, shape a surface, or remove surface materials, such as contaminants, paint, etc. The stream of abrasive material may be wet or dry.

FIG. 1 illustrates a typical abrasive blasting process (or system) 100. One particular process commonly known as sand-blasting (a form of dry media blasting) has been used for decades, to clean or otherwise prepare various types of structural surfaces. In this type of process 100, a supply of sand (or other types of particles, such as grit or the like) 114 is mixed with a fast-moving stream of air 112, usually in a mixer or valve 110. The sand particulate 114 becomes entrained in the air 112, and the resultant air-sand mixture 106 emerges at high speed from a nozzle 105 at the end of a blast hose 104. The mixture 106 is highly abrasive, and sand-blasting can be used to remove even strongly-adhered compounds (e.g., paint, etc.) from various types of structural surfaces 108.

The discharge of the air-sand mixture 106 is hazardous for multiple reasons. First, particulate from the discharge, and as well as the blasted-surface, will linger in the air in the form of a cloud 107, making breathing difficult. As such, a breathing hood or suit 101 may be worn by an operator 102 (the suit 101 may be fed breathing air 103). However, the suit 101 does not protect against the discharge from inadvertent handling of the blast hose 104.

When blasting at high pressures (100 psi or more), discharge 106 can reach speeds in excess of 500 mph, which means if the discharge 106 hits the operator 102, the impact may be deadly and as a minimum the body will shred to the bone. To mitigate or prevent gruesome injuries or death, a safety system may be utilized.

A typical deadman is an on/off system operable to quickly shutdown a hazardous piece of equipment in the event the operator loses engagement of the switch for any reason. The switch is associated with where the operator may hold the equipment, akin to the way one might hold a deadman handle of a lawnmower—when the mower deadman handle is released, a clutch is released, and the blade of the mower stops spinning. With regard to blast equipment, once the operator 102 releases the deadman (voluntarily or involuntarily), the flow of air and grit will cease via valve cut-off.

However, although the controlled air and grit valves will close, there is residual compressed air, laden with grit, contained in the blast hose downstream of the cut-off point that will continue to exhaust through the blast nozzle until the pressure inside the hose is equal to atmospheric pressure. The vent time will vary with the effective flow area of the nozzle and the volume of residual compressed air to be exhausted, and can take as much as ten seconds after release of the deadman switch to purge the system.

To address this timing problem, the Applicant developed a deadman system able to safely dissipate the residual compressed air in about one second through an ON/OFF combination valve configuration that simultaneously controlled the blast air and an exhaust (or vent) port. That is, when the deadman is released, the combination valve closes off the operational air blast feed, while simultaneously opening the vent port for the blast line.

Unfortunately, this deadman configuration resulted in undesired effects. First, there is an abrupt and violent release of compressed air and abrasive through the vent port that, while muffled, is extremely loud. While this might be a tolerable problem in the event of a rare-occurring emergency, the operational reality is that the deadman is frequently released for non-emergency purposes Second, although rapid dissipation is predominantly through the vent port, this system configuration still releases abrasive in areas proximate to the blasting equipment. Because this release occurs each and every time the operator releases the deadman (including for all non-emergency releases), abrasive accumulates or piles up around the blowdown muffler. This unintended consequence requires the operator to remove or reclaim the expended abrasive, resulting in wasted manhours.

As yet another problem, the exhaust hose wears at the pinch point of the combination valve. Over time, the pinch ram no longer seals or ruptures the hose, thereby requiring frequent replacement of the hose, thus adding more maintenance and potential for down time.

Finally, although an electric deadman is instantly responsive and provides the rapid shutdown benefit, not all hazardous areas are tolerable of electrical systems. While an electric deadman may provide an almost instantaneous signal to the control valves that in turn control downstream valves, the same cannot be said for a pneumatic deadman.

In a pneumatic deadman configuration, the twinline pressure is at the same pressure as the compressor, traditionally in the 100 to 150 psi range. The related control valves may have a spool shift, or activation/deactivation, pressure of 30 to 40 psi. Depending on twinline length, it could take upwards of six seconds for the twinline pressure to reach the control valve deactivation pressure to signal downstream valves to start the emergency shutdown. Tragically, anything beyond two seconds of system reaction time may be fatal.

A need exists in the art for an abrasive blasting system and process that may rapidly cease operation, and further has mitigated or reduced sound pollution, as well as provides an operator non-emergency capability that does not result in undesired buildup of expended abrasive. A need exists for an alternative to an electric deadman whereby a rapid response abrasive blasting system may be used in hazardous areas prohibitive to electrical components.

SUMMARY

Embodiments of the disclosure pertain to an abrasive blasting system comprising that may include a blast hose and a deadman assembly coupled with the blast hose. The deadman assembly may include a primary deadman switch. There may be a secondary deadman switch. The deadman may have a base frame. In aspects, one of or both of the primary deadman switch and the secondary deadman switch coupled with the base frame.

The deadman assembly may have a movable trigger member. For example, the trigger member may be movably (such as pivotably) coupled with the base frame. The trigger member may be configured to contact and move the primary deadman switch to a signal-flow position. The trigger member may be able to contact and move the secondary deadman switch to a respective signal-flow position.

The blasting system may have an air source configured for fluid communication with the blast hose. There may also be a primary control valve in signal communication with the primary deadman switch and also in fluid communication with the air source. In aspects, there may be a secondary control valve in signal communication with the secondary deadman switch and also in fluid communication with the air source.

The deadman assembly may be configured with a lock flap movably engaged between the base frame and the trigger member. In aspects, the lock flap may include a first lock flap position. There may also be a second lock flap position and a third flap position.

The signal-flow position may include one or both of the primary and secondary deadman switches are configured to transmit a control signal. When the lock flap is in the first lock flap position the trigger member may be prohibited from closing the primary and secondary deadman switches. When the lock flap is in the second lock flap position, the trigger member may be prohibited from engaging the secondary deadman switch. When the lock flap is moved to the third lock flap position, the trigger member may not be prohibited from engaging the secondary deadman switch. The trigger member may be biased to a no-blast position.

The lock flap may be biased to the first lock flap position. The trigger member may have a recess for an end of the lock flap to reside therein when the lock flap is moved to the second lock flap position.

The abrasive blasting system may include a shut off valve in operable communication with the primary control valve. There may be an air valve in operable communication with the secondary control valve. There may be a media (metering) valve also in operable communication with the secondary control valve. Operation of the shut off valve may be independent of the air valve.

The primary deadman switch and the secondary deadman switch may be electrical. The switches may be configured to pass or stop transmission of an electrical signal. In the alternative, the switches may be pneumatic. The switches may be configured to pass or stop transmission of a pneumatic signal. The control signal may thus be one of pneumatic or electrical.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein:

FIG. 2A shows a process diagram view of an abrasive blasting system in a no-blast or emergency shutdown mode according to embodiments of the disclosure;

FIG. 2B shows a logic view of a switch assembly configuration for the no-blast or emergency shutdown mode of FIG. 2A according to embodiments of the disclosure;

FIG. 2C shows a close-up side cross-sectional view of a deadman assembly for the no-blast or emergency shutdown mode of FIG. 2A according to embodiments of the disclosure;

FIG. 3A shows a process diagram view of an abrasive blasting system in a no-blast, nozzle-vent mode according to embodiments of the disclosure;

FIG. 3B shows a logic view of a switch assembly configuration for the no-blast, nozzle-vent mode of FIG. 3A according to embodiments of the disclosure;

FIG. 3C shows a close-up side cross-sectional view of a deadman assembly for the no-blast, nozzle-vent mode of FIG. 3A according to embodiments of the disclosure;

FIG. 4A shows a process diagram view of an abrasive blasting system in a blast mode according to embodiments of the disclosure;

FIG. 4B shows a logic view of a switch assembly configuration for the blast mode of FIG. 4A according to embodiments of the disclosure;

FIG. 4C shows a close-up side cross-sectional view of a deadman assembly for the blast mode of FIG. 4A according to embodiments of the disclosure;

FIG. 5A shows a process diagram view of a pneumatic abrasive blasting system in a no-blast or emergency shutdown mode according to embodiments of the disclosure;

FIG. 5B shows a logic view of a valve assembly configuration for the no-blast or emergency shutdown mode of FIG. 5A according to embodiments of the disclosure;

FIG. 5C shows a close-up side cross-sectional view of a deadman assembly for the no-blast or emergency shutdown mode of FIG. 5A according to embodiments of the disclosure;

FIG. 7A shows a process diagram view of a pneumatic abrasive blasting system in a blast mode according to embodiments of the disclosure;

FIG. 7B shows a logic view of a valve assembly configuration for the blast mode of FIG. 7A according to embodiments of the disclosure;

FIG. 7C shows a close-up side cross-sectional view of a deadman assembly for the blast mode of FIG. 7A according to embodiments of the disclosure.

DETAILED DESCRIPTION

Figure 1:
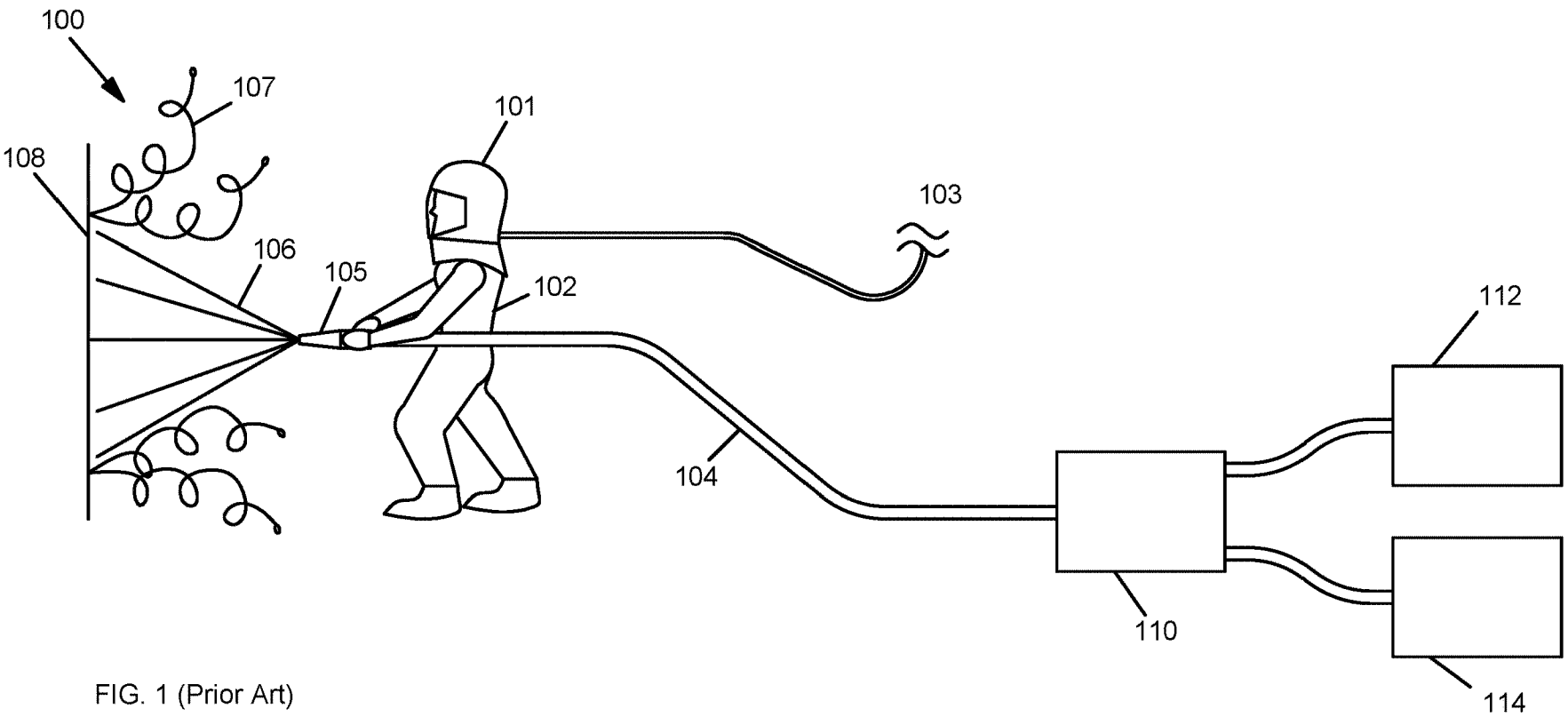
FIG. 1 (Prior Art)
FIG. 1 shows a general side view of a conventional blasting system.

Regardless of whether presently claimed herein or in another application related to or from this application, herein disclosed are novel apparatuses, units, systems, and methods that pertain to abrasive blasting, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "pipe", "conduit", "line", "tubular", or the like as used herein may refer to any fluid transmission means, and may (but need not) be tubular in nature. The term may also apply to other forms of transmission, such as electrical.

The term "composition" or "composition of matter" as used herein may refer to one or more ingredients, components, constituents, etc. that make up a material (or material of construction). Composition may refer to a flow stream of one or more chemical components.

The term "utility fluid" as used herein may refer to a fluid used in connection with the operation of an abrasive blasting device, such as a grit (sand), air, or water. The utility fluid may be for blasting, heating, cooling, or other type of utility. 'Utility fluid' may also be referred to and interchangeable with 'service fluid' or comparable.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth.

The term "non-emergency release" as used herein may refer to a voluntary release of a trigger/level mechanism of a deadman assembly in order to accomplish some other task, such as a break for shift change, a meal, or visit to a restroom, or to reposition for blasting a new area.

The term "deadman" as used herein may refer to an operable system or assembly utilizing some form of switch or comparable mechanism that, upon release of the 'deadman', results in shutdown. With respect to a blasting operation, release of the deadman may refer to a shutdown of media transfer through a blast line.

The term "control valve" as used herein may refer to a valve configured to control flow of a fluid, a solid, a slurry, etc. through the valve by varying the size of the flow passage as directed by a signal from a controller. The opening or closing of a control valve may be by electrical, hydraulic, or pneumatic actuators, or the like. The control valve may receive a signal from a deadman assembly in order to control other valves such as metering, combination or air valves.

The term "pneumatic" as used herein may refer to a device or piece of equipment operable or otherwise responsive to some form of air (or other suitable gas) pressure.

The term "metering valve" as used herein may refer to a type of valve associated with a solid, such as sand, grit, and the like. Such a valve may be multi-function. For example, the metering valve may control flow of the solid into a compressed air stream. Another function may be to regulate the solid flow by changing the orifice size in the valve body. The larger the orifice the greater the solids flow.

The term "twinline" as used herein may refer to a dual-configured hose having a supply side hose and signal side hose that are attached together in a way to form a "twinline". The supply side air may be connected to air piping and the pneumatic deadman control switch. As such, when the deadman lever is depressed, or activated, the switch port may be opened and the compressed air may then flow into the signal side hose of the twinline. This signal may be carried or otherwise transferred to the control system on the abrasive unit to activate air and abrasive controls. Embodiments herein may utilize a multi-hose configuration that may include a 'twinline', as well as one or more additional hoses (e.g., 3 hoses).

The term "pinch valve" or "pinch ram valve" may refer to a multi-direction (e.g., 2-way) valve operable to shut-off or control the flow of compressed air and/or corrosive, abrasive or granular media. The valve may utilize pressurized air to open or close. In the open position, the valve may have no restriction, and thus allows a wide range of compressed air and/or media to pass through its bore. The closed position may result in no flow through its bore. There may be a "shut off" valve.

Referring now to FIGS. 2A, 2B, and 2C together, a process diagram view of an abrasive blasting system in a no-blast or emergency shutoff mode, a logic view of a switch assembly configuration, and a close-up side cross-sectional view of a deadman assembly, respectively, illustrative of embodiments disclosed herein, are shown.

FIGS. 2A-2C illustrate an abrasive blasting system 200 for use in treating a surface 208. As shown here, the blasting system 200 may be in a no-blast or emergency shutdown mode or configuration, which normally entails an operator 202 releasing (or otherwise not squeezing/engaging) a deadman assembly 215. The system 200 may be vented, in that an exhaust or vent line 230 is open.

The deadman assembly 215 may be associated with switch logic 215A shown in FIG. 2B, which may be in operable communication with a power source 213. Although shown here as an electrical configuration, embodiments herein are not meant to be limited, and other power configurations for the deadman assembly 215 (and system 200) are possible, such as pneumatic, hydraulic, and so forth.

The deadman assembly 215 may be suited for applications that permit a blast nozzle 205 (or an area proximate thereto) to be held by an operator 202 facing forward during operation. As shown here, when a trigger or lever 240 is in an unengaged (or unsqueezed, etc.) or released position (FIG. 2C) a primary switch 218 and a secondary switch 226 may be in a corresponding open or unengaged position. In embodiments, one or both of the primary switch 218 and the secondary switch 226 may have a normally open configuration.

While described as 'open' here, the crux of FIG. 2B illustrates that a control signal may be withheld or otherwise disabled in a manner that the signal does not communicate past the controllers 220, 221. As such, when the switches 218, 226 are open, respective controllers 220 and 221 prevent an airflow signal 212*a* from transferring from airflow source 212 to respective downstream valves. The airflow signal to the combo, metering and air valves 228, 224, 222 may be vented through vents 223.

Air source 212 may be in fluid communication with multiple flow paths. For example, source 212 may provide control valve air source 212*a*, as well as blast air source 212*b*. Air source 212*a* may feed control valves 220, 221. When control valve 220 is activated, the valve 220 may signal the combo valve 228 to open air flow to blast air valve 222 and supplies air to control valve 221. When control valve 220 is deactivated, the signal air to the combo valve 228 and supply air to control valve 221 may be vented from control valve vent 223.

In this respect, the primary controller 220 may prevent airflow 212*a* from transferring to combination valve 228. 'Combination valve' in this sense means the valve 228 may have a combined dual function associated with it, such as controlling blast air 212*b*, while at the same time pinching/unpinching the exhaust line 230 in an area proximate to pinch point 232. As shown here, a ram 231 may be in a normally open position when airflow 212*a* is withheld from the valve 228. At the same time, valve end 231*a* may be closed, therefore preventing blast air 212*b* to flow to the air valve 222.

In a similar vein the secondary controller 221 may prevent airflow 212*a* from transferring. As shown here, the blast air valve 222 and the metering valve 224 may be in a normally closed position, whereby blast air 212*b* and (dry) media 214*a* are prevented from entering mixing zone or region 210.

Either of the controllers 220, 221 may be solenoid-type valves, such as an electrically-operated valve. In this respect, the controllers 220, 221 may configured as a valve that uses electromagnetic force (electric signal) to operate. That is, when an electrical current is passed through a solenoid coil of the valve, a magnetic field is generated which causes a ferrous metal rod to move (not viewable here). When the rod moves, it may open up the port whereby supply airflow 212*a* becomes akin to signal air. When the electric signal is removed, such as when the deadman 215 is released, the port may close as a result of bias member. This configuration constitutes a normally closed control valve. Normally open control valve would have the port from supply air to the signal air open unless the control valve receives an electrically signal. As such, one or both of the controllers 220, 221 may have a normally closed configuration.

In the event the deadman assembly 215 was previously engaged, but then released, there may be residual flow 206*a* within the blast line 204. However, as the exhaust line 230 may be unpinched, residual flow 206*a* may exit an outlet 234*a* of a muffler 234. The exhaust line 230, muffler 234, and outlet 234*a* may be sized and otherwise configured to promote rapid dissipation therethrough of any residual flow 206*a*.

A close-up view of the deadman assembly 215 in the no-blast or emergency shutdown configuration may be seen in FIG. 2C, which illustrates primary and secondary switches 218 and 226 in their unengaged (or open) positions. The trigger 240 may be movingly (such as pivotably) coupled with the frame 242, such as at pivot point 241. The trigger 240 may be biased away from engaging the switches 218, 226, such that an amount of squeezing force may be needed in order to move the trigger 240.

Any initial attempt to squeeze the trigger 240 may be impeded by coming into contact with an end 248*a* of a lock flap 248. The lock flap 248 may be movingly (such as pivotably) coupled with the frame 242, such as at pivot point 241*a*. The lock flap 248 may have a first position. The first position of the lock flap 248 may prevent the trigger (or respective cantilever tabs) from engaging (closing) the switches 218, 226. The lock flap 248 may be biased (such as with a spring) to the first position.

Either or both of the switches may be protected via a sheathing 249. The switches 218, 226 may be coupled with the logic circuit (215A-C) and respective controllers via wiring, lines, infrared, or other suitable signal transmission configuration. As shown here, wiring 219 may be disposed within a switch cavity 243. The cavity 243 may be enclosed in order to prevent or mitigate against the presence of debris, particulate, etc.

Referring now to FIGS. 3A, 3B, and 3C together, a process diagram view of an abrasive blasting system in a no-blast, nozzle-vent mode, a logic view of a switch assembly configuration, and a close-up side cross-sectional view of a deadman assembly, respectively, illustrative of embodiments disclosed herein, are shown.

FIGS. 3A-3C illustrate the abrasive blasting system 200 for use in treating the surface 208 moved to a no-blast, nozzle-vent mode (or sometimes non-emergency). As shown here, this mode normally entails an operator 202 partially releasing the deadman assembly 215 in a manner whereby the trigger/lever 240 may energize the primary switch 218, but is prohibited from doing the same for the secondary switch 226. This results in logic configuration 215B.

As the controller 220 may now be open, airflow 212*a* may be transferred to the combo valve 228 in sufficient enough manner to move (urge) the ram 231 ram against the exhaust line 230 at pinch point 232, thereby 'closing' off the line 230.

In normal operation, the operator 202 may be engaged in blast mode (see FIGS. 4A-4C), but then desires a non-emergency release, whereby the line 230 stays closed, and any remnant air and media 206*a* is released out of the nozzle 205. Although theoretically the Figures may also represent the temporal shift from the no-blast mode (of FIGS. 2A-2C), there would be limited functionality as there is likely to be no sustainable (residual) air in the blast hose. As such, FIGS. 3A-3C may generally represent the shift from the blast mode (of FIGS. 4A-4C) to a non-emergency (partial) release of the deadman assembly 215.

Only when the operator 202 manually toggles a lock flap 248 out of the way of the handle 240 will the operator 202 be able to fully squeeze the handle 240 in order to engage/close switch 226 (and thus move back to blast mode—FIG. 4C). Otherwise, as shown here in FIG. 3C, the lock flap 248, while no longer in the first position (FIG. 2C), may be configured to prohibit the movement of the handle 240 in order to engage the secondary switch 226 (but yet able to engage the primary switch 218). The lock flap 248 may have an intermediate or second position that allows the trigger to engage primary switch 218, but not engage the secondary switch 226.

For example, an end 248*a* of the lock flap 248, by being moved into recess 247, may be engaged with and prevent movement of the handle 240 from the position shown in FIG. 3C in order to initiate the blast mode (4C). The only way to initiate blast mode is to (manually) move the lock flap 248 out of the way (via pivot connection point 241*a*), which means further moving the end 248*a* out of the recess 247. Only then may the handle 240 now freely move (via pivot connection point 241) toward the switch 226. But unless and until this action occurs, or the handle 240 is released, the deadman assembly 215 may remain in the no-blast, nozzle-vent mode.

Referring now to FIGS. 4A, 4B, and 4C together, a process diagram view of an abrasive blasting system in a blast mode, a logic view of a switch assembly configuration, and a close-up side cross-sectional view of a deadman assembly, respectively, illustrative of embodiments disclosed herein, are shown.

FIGS. 4A-4C illustrate the abrasive blasting system 200 for use in treating the surface 208 moved to a blast mode. As shown here, this mode normally entails an operator 202 fully engaging the deadman assembly 215 in a manner whereby the trigger/lever 240 may energize each of the primary switch 218 and the secondary switch 226, as indicated by depressed switch arrows B. This may only occur then the operator 202 manually moves an end 248*a* of lock flap 248 out of the way (whereby the end 248*a* may be moved further out of or beyond recess 247). When the switches 218 and 226 are engaged, the system 200 may have the logic configuration 215C.

It would be appreciated that in order to accomplish a multi-switch, multi-position configuration of the deadman assembly 215, particular attention may need be paid to how the trigger 240 interacts with the switches 218, 226. It was unexpectedly discovered that some amount of overtravel for one or more of the cantilever tabs 245, 246 may be useful. Overtravel may be referred to as the amount of added distance an actuator moves after the operating position is achieved.

In embodiments, it may be desirous for the switches (or valves) to be aligned in such a way that the secondary switch 226 is in pretravel while the primary switch 218 is activated. As an example, if there is no cantilever tab configured for overtravel: When the primary switch 218 is activated, pretravel 0.07", the secondary switch 246 may have to be at pretravel 0.06" for the 0.01" overtravel in primary switch to allow activation of secondary at pretravel 0.07". Any movement by the operator would cause secondary switch to toggle on and off.

By the addition of the configured cantilever tabs 245, 246, the overtravel in primary and secondary switches may be increased allowing the secondary switch 246 to have "play" so small movements in the lever or trigger 240 will not result in unwanted deactivation of the secondary switch 226. In comparison, FIG. 2C shows the cantilever tab 245 having an undeflected gap 260*a*, whereas FIG. 4C shows the cantilever tab 245 having an overtraveled position gap 260*b*.

The closing of the secondary switch 226 results in activation of the secondary controller 221 in manner whereby signal airflow 212*a* may now transfer to the air valve 222 and the metering valve 224. Once the air valve 222 opens, blast air 212*b* may flow through the valve 222 toward mixer 210. In a similar manner, once the media valve 224 opens, media 214*a* may transfer from media storage 214, through the valve 224, and into mixer 210.

As the vent line 230 remains closed (pinched) [via primary switch 218 engaged and primary controller 220 transferring signal air to combo valve 228], the only path for the mixed air and media 206 is through hose 204 and out of the nozzle 205. The blast media 206 impacts against the surface 208 to accomplish the desired blasting outcome.

Pneumatic Control

Referring now to FIGS. 5A, 5B, and 5C together, a process diagram view of a pneumatic abrasive blasting system in a no-blast emergency shutdown mode, a logic view of a valve assembly configuration, and a close-up side cross-sectional view of a deadman assembly, respectively, illustrative of embodiments disclosed herein, are shown.

The previous Figures and accompanying description make reference to embodiments of an abrasive blasting operation that may utilize a multi-position, multi-configuration deadman assembly. While these Figures may depict use an electric-type control configuration, other control mechanisms are possible, such as pneumatic.

To better illustrate to one of skill appreciable differences, FIGS. 5A-5C (with 6A-6C and 7A-7C) provide for a pneumatic operated blast system (and related methods) 500. While it need not be exactly the same, the system 500 may be assembled, run, and operated as described herein and in other embodiments (such as for system 200, and so forth), and as otherwise understood to one of skill in the art.

Components of the system 500 may be arranged by, disposed on, or otherwise coupled together, as otherwise understood to one of skill in the art. Thus, the system 500 may be comparable or identical in some aspects, function, operation, components, etc. as that of other system embodiments disclosed herein (e.g., 200). Similarities may not be discussed for the sake of brevity, but are otherwise adopted herein.

Associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components of the system 500 for operation thereof. All components of the system 500 requiring power or automation may be provided with wiring, tubing, piping, etc. in order to be operable therefore.

As shown here, the blasting system 500 may be in a no-blast emergency shutdown mode or configuration, which normally entails an operator 502 releasing (or otherwise not squeezing/engaging) a deadman assembly 515. The deadman assembly 515 may be associated with a pneumatic flow control 515A shown in FIG. 5B.

The pneumatic deadman assembly 515 may be suited for applications that permit a blast nozzle 505 (or an area proximate thereto) to be held by the operator 502 facing forward during operation, and is particularly suited for environments that prohibit an electrical component or where electric power is not available. As shown here, when a trigger or lever 540 is in an unengaged (or unsqueezed, etc.) or released position (FIG. 5C) a primary valve 518 and a secondary valve 526 may be in a closed position. While described as 'closed' here (i.e., the valves 518, 526 are closed, and control valves 520 and 521 signal airflow 662 is vented out of the deadman 515 [such as through an unsealed vent or port—not viewable here]), the crux of FIG. 5B illustrates that a control signal may be withheld or otherwise disabled in a manner that the signal does not communicate past the controllers 520, 521. As such, when the valves 518, 526 are closed, respective controllers 520 and 521 prevent an airflow signal 512*a* from transferring airflow from source 512 to respective downstream valves.

Valves 518, 526 may be pneumatic trigger deadman cartridges. The valves 518, 526 may be configured to send air from the reduced pressure air supply coming from regular 550 to the pneumatic control valves 520 and 521, respectively. For example, valve 518 may be configured to send (transfer, etc.) air to the control valve 520 pilot port. 520 then opens and sends a full pressure air signal (before 550) to the combo valve 528 pilot port and the air supply port of 521. The secondary deadman valve 526 may be configured to send air to the secondary control valve 521 pilot port. The secondary valve 521 may then open and sends a full pressure air signal (before 550) to the air valve 522 pilot port and valve 524 pilot port. Although described here as 'combo' valve, the valve 528 may be a simple shut off valve, such as a ball valve or a pinch valve.

The frame 542 may be configured such that the supply air from the fitting on the outside of the frame 542 may flows through the frame (body) to the valves 518 and 526 supply sides, and when engaged by the trigger 540, the control signals from the valves 518 and 526 may then flow through the frame 542 to the fittings on the outside of the frame 542, and then to the control valves 520, 521.

Air source 512 may be in fluid communication with multiple flow paths. For example, source 512 may provide control valve air source 512*a*, as well as blast air source 512*b*. Air source 512*a* may communicate with control valve 520. When control valve 520 is activated, the valve 520 may signal the combo valve 528 to open, thereby permitting air flow to blast air valve 522. As shown here, when control valve 520 is deactivated, the signal air to the combo valve 528 and supply air to control valve 521 may be vented 523.

The pneumatic blasting system 500 may use an air pressure regulator 550 to reduce the air pressure (of signal air 512*a*) to the deadman assembly 515. By way of brief comparison, a typical pneumatic deadman control is not regulated. As a result, abrasive air blast equipment control air, including the remote deadman control line is typically at 100-150 psig. Abrasive air blast equipment with a pneumatic remote deadman connect the signal side of the deadman to a pneumatic pilot operated control valve because the deadman valve's flow is too low to quick actuate and deactivate the air and abrasive valves on the equipment.

These pilot operated control valves typically have an activation and a deactivation pressure at the pilot (deadman signal) port. Also, the deactivation pressure is typically lower than activation pressure when applied to the control valve pilot port. This difference is typically 7-15 psig but could be vary slightly more or less.

In a conventional pneumatic deadman, the response time from release of deadman to deactivation of the pilot operated control valves is known to exceed four seconds (for example, with the deadman signal lines at 120 psig). The excess time for deactivation occurs because the deadman signal (unregulated) line pressure to the control valves are at the same pressure as the air source upon release of deadman to shut off blasting. All of the pressure in the line in excess of the deactivation pressure of the control valve must first be vented through the deadman valves in order for the control valve to close (deactivate).

With present embodiments of the disclosure, when the trigger 540 is manually pressed or squeezed to the blast mode (see FIGS. 7A-7C), the deadman valves 518, 526 may allow the compressed air 512*a* at the supply port (of the respective valves 518, 526) to now flow into the signal port and then to the pilot port of the respective control valves 520, 521. This pressure may be determined by the regulator 550. So for example, the pressure in the line between the deadman 515 and the control valves 520, 521 may be a reduced, regulated pressure of about 70 psig (as compared to source 512, which may be in excess of 120 psig).

The control valves 520, 521 may then activate when sufficient pressure is generated at the pilot port and allows compressed air 512*a* to actuate the abrasive, air, and quick exhaust (combo) valves 524, 522, and 528, respectively.

When the deadman 515 is manually released to the position shown in FIG. 5C, the deadman supply port is shut off and the deadman signal or pilot port is vented to atmospheric through the remote deadman valves 518, 526 until the pressure drops below the control valve deactivation pressure at the pilot port. The control valve(s) 520, 5210 may then shut off air pressure and vent the signal line of the abrasive, air, and exhaust valve to atmospheric through vents 523.

With the air pressure regulator 550 upstream of the deadman 515 supply line, embodiments herein provide for the ability to reduce the deadman to control valve deactivation OFF response time to about one second or less by reducing this pressure differential. In embodiments the pressure differential between the deadman assembly 515 and the control valves 520, 521 deactivation point may be in the range of about 10 to 20 psi.

When the deadman 515 is released, the air may vent through the deadman 515 until the air pressure control valve signal force is lower than the return spring force. The spring may then close the port and the air signal to the air and abrasive valves is vented closing both valves.

In some embodiments, it may be desirous to exceed minimum activation pressure to create a functional buffer to assure ample pressure to activate the control valves because the activation pressure could increase with wear and accumulation of contamination from normal use.

By regulating the pressure in deadman supply line down to 75-80 psi and increasing the spool spring tension to increase the spool shift pressure to 55-60 psi, the differential pressure between the deadman supply line and control valve is reduced from about 80 psi to 20 psi. This reduces the time for control valve deactivation considerably. In embodiments, the elapse of time between deadman release and control valve deactivation is less than 2 seconds. In other embodiments, the elapse of time is in a range of about 0.1 seconds to no more than 2 seconds.

Higher pressure, at the same 20 psi pressure differential between deadman supply line and control valve, will result in faster control valve deactivation time.

In this respect, the primary controller 520 may prevent airflow 512*a* from transferring to combination valve 528. As shown here, a ram 531 may be in a normally open position when airflow 512*a* is withheld from the valve 528. At the same time, valve end 531*a* may be closed, therefore preventing blast air 512*b* to flow to the air valve 522.

In an analogous manner the secondary controller 521 may prevent airflow 512*a* from transferring to blast air valve 522 through control valve 520. As shown here, the blast air valve 522 and the media control (metering) valve 524 may be in a normally closed position, whereby blast air 512*b* and (dry) media 514*a* are prevented from entering mixing zone or region 510.

In the event the deadman assembly 515 was previously engaged, but then released, there may be residual flow 506*a* within the blast line 504. However, as the exhaust line 530 may be unpinched, residual flow 506*a* may exit an outlet 534*a* of a muffler 534. The exhaust line 530, muffler 534, and outlet 534*a* may be sized and otherwise configured to promote rapid dissipation therethrough of any residual flow 506*a*.

A close-up view of the deadman assembly 515 in the no-blast emergency shutoff configuration may be seen in FIG. 5C, which illustrates primary and secondary valves 518 and 526 in open or airflow-off positions. The operation of the assembly 515 may be like that as otherwise described herein, and reference may be made to, for example, FIG. 5C for an understanding of the operation of the trigger 540, lock flap 548, etc.

The valves 518, 526 may be coupled with the logic flow (515A-C) and respective controllers via wiring, lines, infrared, or other suitable signal transmission configuration. As shown here, wiring (for air feed) 519 may be disposed within a cavity 543. The air feed may be coupled with the deadman supply line via couplers, fittings, nipples, etc.

In embodiments, there may be a deadman/hose configuration that may include one hose used for the supply air and one for the signal. In this way, the deadman assembly 515 may be a 3-position, 2-function pneumatic deadman configured in operable communication with a multi-hose configuration, such as a "tripleline"—a hose configured to accommodate two signals sent to an abrasive blast unit, one for each control valve, plus the supply hose.

In aspects, there may be an airline configured in a manner to connect to fittings within the deadman 515 configured to communicate with valves 518, 526. An opposite, respective end(s) of the airline may be configured to couple with the regulator 550 and valves 520, 521.

Figures 6A, 6B, 6C:
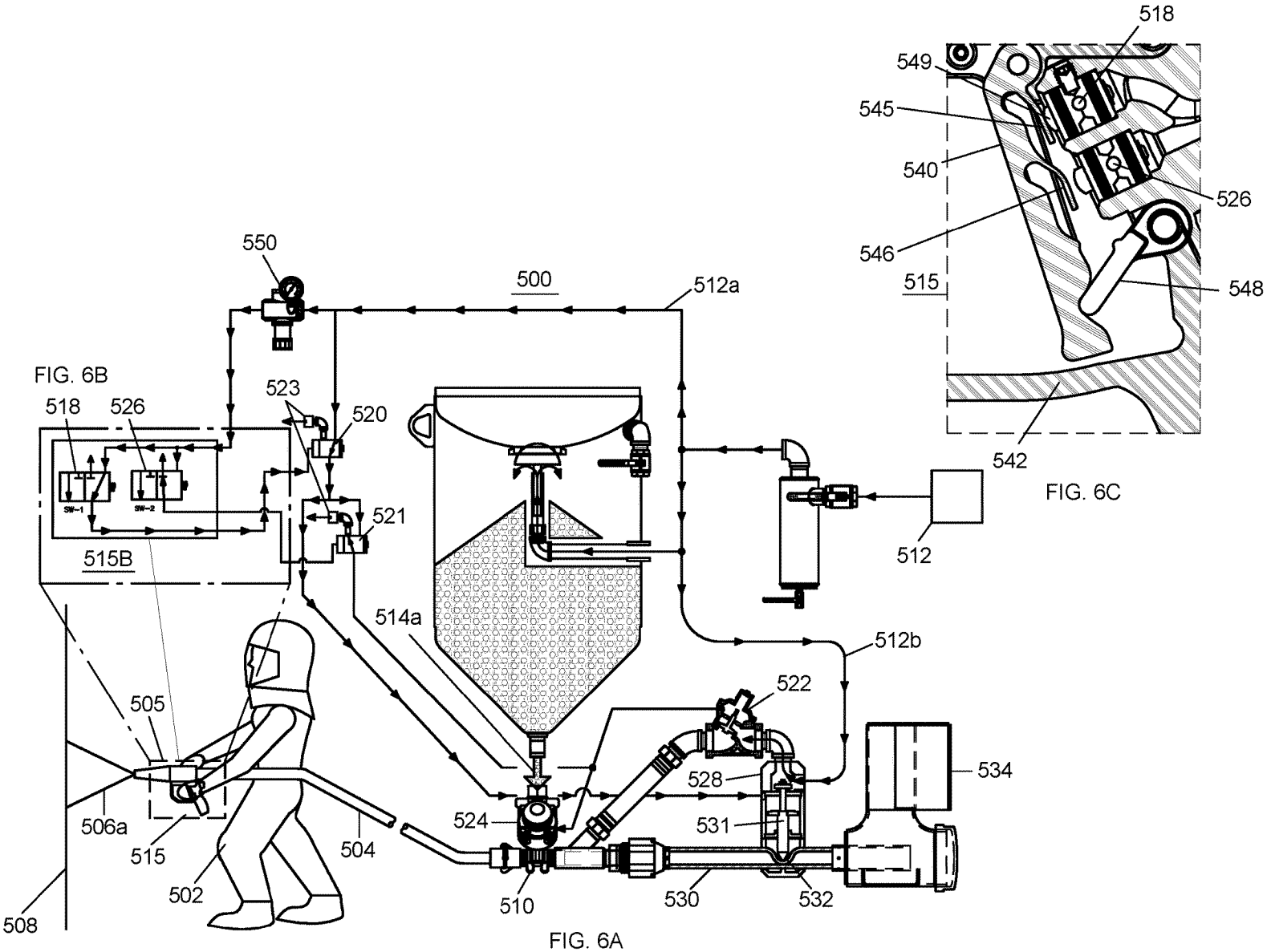
FIG. 6A shows a process diagram view of a pneumatic abrasive blasting system in a no-blast, nozzle-vent mode according to embodiments of the disclosure.
FIG. 6B shows a logic view of a valve assembly configuration for the no-blast, nozzle-vent mode of FIG. 6A according to embodiments of the disclosure.
FIG. 6C shows a close-up side cross-sectional view of a deadman assembly for the no-blast, nozzle-vent mode of FIG. 6A according to embodiments of the disclosure.

Referring now to FIGS. 6A, 6B, and 6C together, a process diagram view of a pneumatic abrasive blasting system in a no-blast, nozzle-vent mode, a logic view of a switch assembly configuration, and a close-up side cross-sectional view of a deadman assembly, respectively, illustrative of embodiments disclosed herein, are shown.

FIGS. 6A-6C illustrate the abrasive blasting system 500 for use in treating the surface 508 moved to a no-blast, nozzle-vent mode (or sometimes non-emergency). As shown here, this mode normally entails an operator 502 partially releasing the deadman assembly 515 in a manner whereby the trigger/lever 540 may yet energize the primary valve 518, but is prohibited from doing the same for the secondary valve 526. This results in logic configuration 515B.

As the controller 520 may now be open, airflow 512*a* may be transferred to the combo valve 528 in sufficient enough manner to move (urge) the ram 531 ram against the exhaust line 530 at pinch point 532, thereby 'closing' off the line 530.

Only when the operator 502 manually toggles a lock flap 548 out of the way of the handle 540 will the operator 502 be able to fully squeeze the handle 540 in order to engage/close valve 526. Otherwise, as shown here in FIG. 6C, the lock flap 548, while no longer in the first position (FIG. 5C), may be configured to prohibit the movement of the handle 540 in order to engage the secondary valve 526 (but yet able to engage the primary valve 518).

For example, an end 548*a* of the lock flap 548, by being moved into recess 547, may be engaged with and prevent movement of the handle 540 from the position shown in FIG. 6C in order to initiate the blast mode (7C).

Referring now to FIGS. 7A, 7B, and 7C together, a process diagram view of a pneumatic abrasive blasting system in a blast mode, a logic view of a switch assembly configuration, and a close-up side cross-sectional view of a deadman assembly, respectively, illustrative of embodiments disclosed herein, are shown.

FIGS. 7A-7C illustrate the abrasive blasting system 500 for use in treating the surface 208 moved to a blast mode. As shown here, this mode normally entails an operator 502 fully engaging the deadman assembly 515 in a manner whereby the trigger/lever 540 may energize each of the primary valve 518 and the secondary valve 526, as indicated by depressed switch arrows B. This may only occur then the operator 502 manually moves an end 548*a* of lock flap 548 out of the way (whereby the end 548*a* may be moved further out of or beyond recess 547). When the switches 518 and 526 are engaged, the system 500 may have the logic configuration 515C.

The closing of the secondary valve 526 results in activation of the secondary controller 521 in manner whereby signal airflow 512*a* may now transfer to the air valve 522 and the metering valve 524. Once the air valve 522 opens, blast air 512*b* may flow through the valve 522 toward mixer 510. In a similar manner, once the metering valve 524 opens, media 514*a* may transfer from media storage 514, through the valve 524, and into mixer 510.

As the vent line 530 remains closed (pinched) [via primary switch 518 engaged and primary controller 520 transferring signal air to combo valve 528], the only path for the mixed air and media 506 is through hose 504 and out of the nozzle 505. The blast media 506 impacts against the surface 508 to accomplish the desired blasting outcome.

Figure 8:
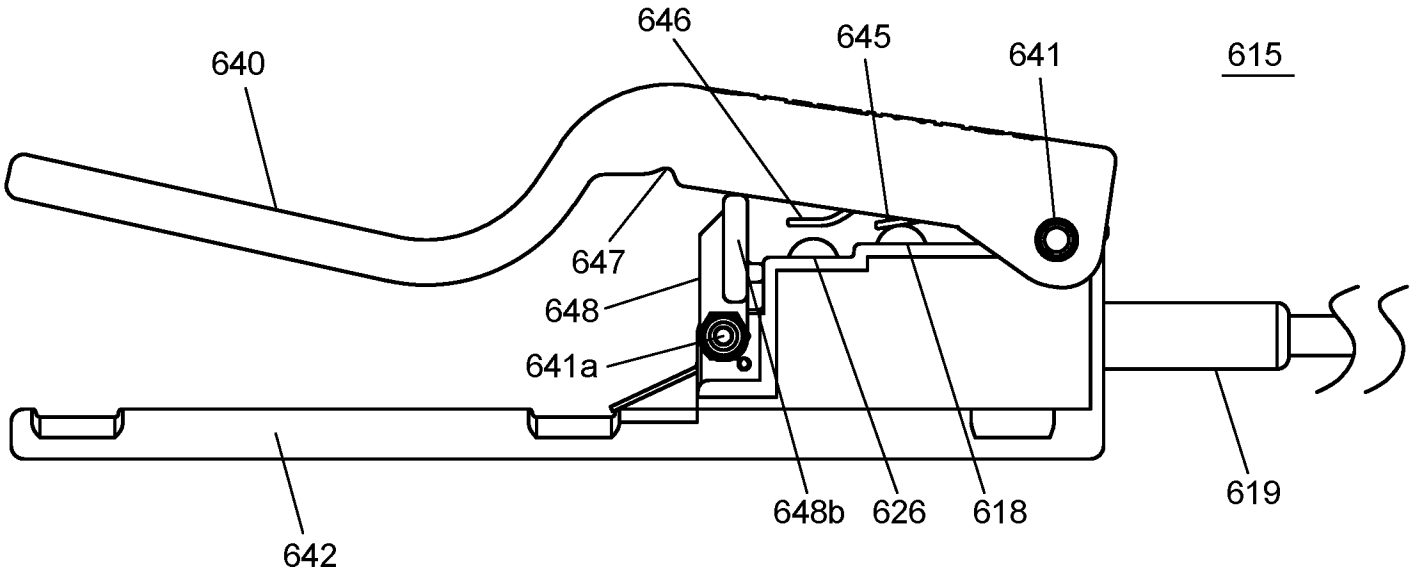
FIG. 8 shows a longitudinal side view of a deadman assembly according to embodiments of the disclosure.

Referring now to FIG. 8 a longitudinal side view of a deadman assembly, illustrative of embodiments disclosed herein, is shown. FIG. 8 shows by way of example a non-limiting embodiment of a deadman assembly 615 suitable for use with blasting methods and systems of the present disclosure, or for adding to new blasting systems or retrofitting to existing.

The deadman assembly 615 may be associated with switch logic (e.g., 215A, 215B, 215C, etc.) described herein, and thus may have a multi-position, multi-function configuration. The deadman assembly 615 may be in operable communication with a power source (not shown here) via wiring 619. The power source may be electrical, pneumatic, and so forth.

The deadman assembly 615 may be suited for applications that permit a blast nozzle to be held by an operator facing forward during operation. As shown here, when a trigger or lever 640 is in an unengaged (or unsqueezed, etc.) or released position (FIG. 2C) a primary signal control 618 and a secondary signal control 626 may be in an open or signal-stopped position. Signal controls 618, 626 may be biased open or closed; whatever the case may be, when a lock flap 648 is in its shown first position, an activation signal may not be transmitted further downstream (such as to a valve).

The lock flap 648 may be biased to the first position, such as by a spring. The lock flap 648 may be movingly (such as pivotably) coupled with a frame 642 of the deadman assembly 615 at coupling point 641*a*. Although not shown here, when an operator (e.g., 202) desires to engage in a blast mode, the operator may use a finger to push pad 648*b*, thereby moving a flap end 648*a* out of blocking engagement of a trigger lever 640.

The trigger lever 640 may be movingly (such as pivotably) coupled with the frame 642 at coupling point 641. In the event the lock flap 648 resides in recess 647, the operator will be unable to move the trigger lever 640 enough to engage cantilever tab 646 with secondary signal control 626. As such, in this second lock flap position, only cantilever tab 645 may engage the respective signal control 618.

To engage or return to blasting, the operator must further move the lock flap 648 out of the recess 647 to a third or blast flap position. At this point, both signal controls 618, 626 may be activated in manner whereby downstream signal transmission may occur (such as to a metering valve, air valve, and/or combo vent valve).

Embodiments herein may provide for methods of use and operation of one or more systems disclosed herein or comparable variants. Methods herein may refer to use and/or operation of an abrasive blasting operation that may utilize a multi-position, multi-configuration deadman assembly. While referred to as pneumatic, other control mechanisms are possible, such as electrical.

The method may include providing or arranging for one or more abrasive blasting components, such as a hose, blast pot, control valves, a deadman assembly, and so forth. The method may include use and/or operation of associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components for operation thereof. All components of the method requiring power or automation may be provided with wiring, tubing, piping, etc. in order to be operable therefore.

The method may include use and/or operation of a deadman assembly that may be associated with a pneumatic flow control or comparable. The method may include operating the deadman assembly in a blast mode or a no-blast mode. There may be a no-blast, nozzle vent mode.

The method may include configuring the deadman assembly with one or more pneumatic trigger deadman cartridges operable to send or transfer air from the reduced pressure air supply coming from regulator to respective pneumatic control valves.

The method may include coupling respective hosing to fittings associated with the deadman assembly, air source, regulator, control valves, and any other downstream equipment. The air pressure regulator may be set to reduce the air pressure to the deadman assembly.

The method may include operating or moving a trigger of a deadman assembly to the blast mode (see FIGS. 7A-7C). As such, the deadman assembly valves may allow the compressed air to now flow into the signal port and then to the pilot port of the respective control valves. This pressure may be determined by the regulator. So for example, the pressure in the line between the deadman and the control valves may be a reduced, regulated pressure of about 45 to 70 psig (as compared to the air source, which may be in excess of 120 psig).

The method may include releasing the deadman assembly to shut off, whereby the deadman supply port is shut off and the deadman signal or pilot port may be vented to atmospheric through the remote deadman valves until the pressure drops below the control valve deactivation pressure at the pilot port. The control valve(s) may then shut off air pressure and vent the signal line of the abrasive, air, and exhaust valve to atmospheric through vents.

The method may include a deactivation response time of about one to two seconds or less by reducing this pressure differential.

In some embodiments, it may be desirous to exceed minimum activation pressure to create a functional buffer to assure ample pressure to activate the control valves because the activation pressure could increase with wear and accumulation of contamination from normal use.

Higher pressure, at the same reduced pressure differential between deadman supply line and control valve, will result in faster control valve deactivation time.

In embodiments, there may be a deadman/hose configuration that may include one hose used for the supply air and two for the signal. In this way, the deadman assembly may be a 3-position, 2-function pneumatic deadman configured in operable communication with a multi-hose configuration, such as a "tripleline"—a hose configured to accommodate two signals sent to an abrasive blast unit, one for each control valve, plus the supply hose.

In aspects, there may be an airline configured in a manner to connect to fittings within the deadman configured to communicate with the deadman valves. An opposite, respective end(s) of the airline may be configured to couple with the regulator and valves.

The method may include moving a lock flap movingly coupled with a frame of the deadman assembly. The lock flap may be moved from a first lock flap position to another lock flap position, such as a second or third lock flap position.

The method may include moving the trigger and the lock flap in a suitable manner whereby the trigger may engage one or both of the deadman valves.

Advantages

Embodiments of the disclosure may provide for a fast, responsive shutoff system to address the undesirable side effects without compromising the safety created by the quick response. In particular embodiments herein may mitigate or reduce noise pollution by providing an operator an ability to Control the shutoff method, using the non-emergency shutoff method of venting through the nozzle unless the emergency method is needed. This may synergistically reduce the amount of expended abrasive that would otherwise accumulate around the blast pot from repeated deadman release.

Embodiments of the disclosure may reduce wear on the exhaust line at the pinch point of the valve, thereby extending the time the pinch ram will pinch and seal the line, thus reducing maintenance and associated time and income lost due to down time.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. An abrasive blasting system comprising:

a blast hose;

a deadman device coupled with the blast hose, the deadman device further comprising:

a primary deadman electrical switch;

a secondary deadman electrical switch in series with the primary deadman switch;

a base frame, with each of the primary deadman switch and the secondary deadman switch housed at least partially within the base frame;

a trigger member movably coupled with the base frame, the trigger member configured to contact and move the primary deadman switch to a signal-flow position, and also to contact and move the secondary deadman switch to a secondary signal-flow position;

an air source configured for fluid communication with the blast hose;

a vent line;

a mixer comprising a first portion in communication with the blast hose and a second portion in communication with the vent line;

a primary control valve in signal communication with the primary deadman electrical switch and also in fluid communication with the air source; and a secondary control valve in signal communication with the secondary deadman electrical switch and also in fluid communication with the air source, wherein in the signal-flow position a medium comprising at least one of air, abrasive, and combinations thereof, is transferred from the mixer to the blast hose.

2. The abrasive blasting system of claim 1, wherein the deadman device further comprises a lock flap movably engageable between the base frame and the trigger member, the lock flap comprising a first lock flap position, a second lock flap position and a third flap position.

3. The abrasive blasting system of claim 1, wherein in the signal-flow position the vent line is pinched closed to restrict the medium from transferring from the mixer out of the vent line.

4. The abrasive blasting system of claim 2, wherein when the lock flap is in the second lock flap position, the trigger member is prohibited from engaging the secondary deadman electrical switch, and wherein when the lock flap is moved to the third lock flap position, the trigger member is not prohibited from engaging the secondary deadman electrical switch.

5. The abrasive blasting system of claim 2, wherein the lock flap is biased to the first lock flap position, wherein the trigger member comprises a recess for an end of the lock flap to reside therein when the lock flap is moved to the second lock flap position, and wherein the trigger member is biased to a no-blast position.

6. The abrasive blasting system of claim 1, the system further comprising:

a shut off valve in operable communication with the primary control valve;

an air valve in operable communication with the secondary control valve; and a media (metering) valve also in operable communication with the secondary control valve.

7. The abrasive blasting system of claim 6, wherein operation of the shut off valve is independent of the air valve.

8. The abrasive blasting system of claim 1, wherein the primary deadman electrical switch and the secondary deadman electrical switch are each configured to pass or stop transmission of an electrical deadman control signal.

9. An abrasive blasting system comprising:

a blast hose;

a deadman assembly coupled with the blast hose, the deadman assembly further comprising:

a primary deadman switch;

a secondary deadman switch;

a base frame, with each of the primary deadman switch and the secondary deadman switch coupled with the base frame; and a trigger member pivotably coupled with the base frame, the trigger member configured to contact and move the primary deadman switch to a signal-flow position, and also to contact and move the secondary deadman switch to a secondary signal-flow position;

an air source configured for fluid communication with the blast hose;

a vent line;

a mixer comprising a first portion in communication with the blast hose and a second portion in communication with the vent line;

a primary control valve in signal communication with the primary deadman switch and also in fluid communication with the air source;

a secondary control valve in signal communication with the secondary deadman switch and also in fluid communication with the air source;

a shut off valve in operable communication with the primary control valve;

an air valve in operable communication with the secondary control valve; and a media (metering) valve also in operable communication with the secondary control valve, wherein in the signal-flow position a medium comprising at least one of air, abrasive, and combinations thereof, is transferred from the mixer to the blast hose.

10. The abrasive blasting system of claim 9, wherein the deadman assembly further comprises a lock flap movably engaged between the base frame and the trigger member, and wherein the lock flap comprises a first lock flap position, a second lock flap position and a third flap position.

11. The abrasive blasting system of claim 10, wherein each of the primary and secondary deadman switches are configured to transmit an electric deadman control signal, wherein when the lock flap is in the first lock flap position the trigger member is prohibited from closing the first and second deadman switches.

12. The abrasive blasting system of claim 11, wherein the primary deadman switch and the secondary deadman switch are electrical.

13. The abrasive blasting system of claim 12, wherein when the lock flap is in the second lock flap position, the trigger member is prohibited from engaging the secondary deadman switch, and wherein when the lock flap is moved to the third lock flap position, the trigger member is not prohibited from engaging the secondary deadman switch.

14. The abrasive blasting system of claim 10, wherein when the lock flap is in the second lock flap position, the trigger member is prohibited from engaging the secondary deadman switch, and wherein when the lock flap is moved to the third lock flap position, the trigger member is not prohibited from engaging the secondary deadman switch.

15. The abrasive blasting system of claim 14, wherein the lock flap is biased to the first lock flap position, wherein the trigger member comprises a recess for an end of the lock flap to reside therein when the lock flap is moved to the second lock flap position, and wherein the trigger member is biased to a no-blast position.

16. The abrasive blasting system of claim 9, wherein in the signal-flow position the vent line is pinched closed and occludes the medium from transferring from the mixer out of the vent line.

17. The abrasive blasting system of claim 9, wherein the primary deadman switch and the secondary deadman switch are each configured to pass or stop transmission of an electrical deadman control signal.

18. An abrasive blasting system comprising:

a blast hose;

a deadman device coupled with the blast hose, the deadman device further comprising:

a primary deadman electrical switch;

a secondary deadman electrical switch in electrical series with the primary deadman switch;

a base frame, with each of the primary deadman switch and the secondary deadman switch coupled with the base frame; and a trigger member pivotably coupled with the base frame, the trigger member configured to contact and move the primary deadman switch to a signal-flow position, and also to contact and move the secondary deadman switch to a secondary signal-flow position;

an air source configured for fluid communication with the blast hose;

a vent line;

a mixer comprising a first portion in communication with the blast hose and a second portion in communication with the vent line;

a primary control valve in signal communication with the primary deadman electrical switch and also in fluid communication with the air source; and a secondary control valve in signal communication with the secondary deadman electrical switch and also in fluid communication with the air source, a shut off valve in operable communication with the primary control valve;

an air valve in operable communication with the secondary control valve; and a media (metering) valve also in operable communication with the secondary control valve, wherein in the signal-flow position a medium comprising at least one of air, abrasive, and combinations thereof, is transferred from the mixer to the blast hose, wherein in the signal-flow position the vent line is pinched closed and restricts the medium from transferring from the mixer out of the vent line, and wherein the secondary control valve is arranged in series with the primary control valve whereby upon activation of the primary control valve an air control signal is passed from the primary control valve to the secondary control valve.

19. The abrasive blasting system of claim 18, wherein each of the primary and secondary deadman electrical switches are configured to transmit an electric deadman control signal.

20. The abrasive blasting system of claim 18, wherein the deadman assembly further comprises a first lock flap position, a second lock flap position and a third flap position, and wherein when the lock flap is in the first lock flap position the trigger member is prohibited from closing the primary and secondary deadman electrical switches.

* * * * *